US005444515A

United States Patent [19]

Haneda et al.

[11] Patent Number: 5,444,515

[45] Date of Patent: Aug. 22, 1995

[54] COLOR IMAGE FORMING APPARATUS WITH MOUNTABLE CARTRIDGE THEREIN

[75] Inventors: Satoshi Haneda; Shizuo Morita; Masakazu Fukuchi; Tadayoshi Ikeda, all of Hachioji, Japan

[73] Assignee: Konica Corporation, Tokyo, Japan

[21] Appl. No.: 200,103

[22] Filed: Feb. 18, 1994

[30] Foreign Application Priority Data

Feb. 23, 1993 [JP] Japan ..... 5-033487
Mar. 18, 1993 [JP] Japan ..... 5-058871

[51] Int. Cl.[6] ..... G03G 15/00

[52] U.S. Cl. ..... 355/200; 355/210; 355/326 R

[58] Field of Search ..... 355/200, 210, 211, 260, 355/326 R, 327

[56] References Cited

U.S. PATENT DOCUMENTS 4,996,566 2/1991 Morita et al. ..... 355/326 X
5,249,026 9/1993 Kojima ..... 355/327
5,262,824 11/1993 Morita et al. ..... 355/200 X
5,276,479 1/1994 Inomata ..... 355/200
5,287,161 2/1994 Matsuo et al. ..... 355/326 R
5,298,946 3/1994 Haneda et al. ..... 355/210

*Primary Examiner*—William J. Royer
*Attorney, Agent, or Firm*—Frishauf, Holtz, Goodman, Langer & Chick

[57] ABSTRACT

A color image forming apparatus includes a housing and a cartridge adapted to be attached to or detached from the housing in a horizontal direction. The cartridge includes a photoreceptor and a plurality of developing devices vertically piled up. Each developing device has an opening to receive toner and a cover to open or close the opening. When the cartridge is detached from the housing in the horizontal direction and is placed in a laid down position thereof, toner can be supplied into the developing devices through the opening which is at the top portion of the laid-down cartridge.

11 Claims, 18 Drawing Sheets

COLOR IMAGE FORMING APPARATUS WITH MOUNTABLE CARTRIDGE THEREIN

BACKGROUND OF THE INVENTION

The present invention relates to improvements in technique of a developing unit replacing means, toner supply means, cleaning means and used toner recovery means which are installed in an image forming apparatus, especially a color image forming apparatus having a plurality of developing units on the circumferential surface of an image forming body.

In a color image forming apparatus, image processing is carried out with respect to a plurality of colors. Accordingly, the color image processing apparatus is provided with a plurality of developing units, each unit having the function of developing a mono-color, and also provided with a plurality of toner accommodating containers for supplying toner to the developing units.

The frequency of maintenance of a group of developing units is high. Accordingly, they are integrated into one process cartridge together with a cleaning unit so that they can be easily taken out from the image forming apparatus for maintenance. Therefore, the developing units are connected with or disconnected from the toner accommodating containers and the used toner recovery box each time the cartridge is detached from the image forming apparatus.

However, the construction of a connecting section between the developing units and toner accommodating units or used toner recovery box is complicated, because the leakage of toner must be prevented. Therefore, the handling operation requires much time and labor. Further, it is impossible to avoid the leakage of a small amount of toner during the handling operation of the connecting section. The leaked toner is accumulated over a long period of time, and the inside of the image forming apparatus is stained with the accumulated toner, which deteriorates image quality.

In order to overcome the above disadvantages, the following method is adopted:

The toner accommodating containers and developing units are integrated into one body, and the integrated body is assembled to a process cartridge.

However, as described before, it is necessary to install 3 or 4 developing units in the color image forming apparatus, so that the size and weight of the process cartridge are increased, and further it is necessary to take out the process cartridge from the apparatus each time toner is supplied. For these reasons, the aforementioned method is disadvantageous in that the handling is difficult and it takes time and labor to maintain the process cartridge.

The present invention has been achieved to solve the above problems. The apparatus of the present invention does not require a complicated connection mechanism for toner supply, and further the process cartridge is made compact, so that it can be easily moved to the outside of the apparatus. Furthermore, toner can be easily supplied when the process cartridge is moved by a short distance. In the case where the used toner recovery box is taken out, it can be removed from the process cartridge together with the cleaning unit. When toner is supplied or only the used toner box is taken out so as to be processed, the direction of the process cartridge is restricted so that the toner can not be spilt. As a result, the inside and outside of the image forming apparatus are not stained with leaked toner. It is a first object of the present invention to provide the color image forming apparatus having advantages described above.

It is also the first object of the present invention to provide a color image forming apparatus in which the developing units are assembled to the process cartridge, and under the condition that the process cartridge is attached to the image forming apparatus, toner can be supplied from a side at which the image forming apparatus is operated by an operator.

In general, a plurality of developing units having color toners of various colors are installed in a color image forming apparatus. For the cleaning, inspection and replacement operations of the developing units, they are integrated into a process unit together with a photoreceptor, or alternatively they are individually installed in the color image forming apparatus in such a manner that they can be easily attached to or detached from the apparatus, and further a conveyance passage of transfer sheets can be opened when the developing units are detached.

However, as is well known, a side of the developing unit opposed to the photoreceptor is widely open. Therefore, when the developing unit is inclined or vibrated, the accommodated toner drops or scatters from the unit, so that the conveyance surface of a transfer sheet is stained with toner, which deteriorates image quality. In the case where color toner is supplied to the developing unit, the conveyance surface of a transfer sheet is stained with toner in the same manner.

The present invention has overcome the above disadvantages. It is a second object of the present invention to provide a color image forming apparatus in which the developing units can be attached to and detached from the apparatus without the dropping and scattering of color toner, so that the operations of jam clearance and toner supply can be safely carried out.

SUMMARY OF THE INVENTION

The first object of present invention described above can be accomplished by the following technical means of a color image forming apparatus.

In the color image forming apparatus, a process cartridge includes a belt-shaped photoreceptor disposed at least in a vertical direction which works as an image forming body, and also includes a plurality of developing units disposed in a vertical direction in parallel on a vertical surface of the belt-shaped photoreceptor, wherein the process cartridge can be horizontally attached to and detached from the color image forming apparatus. In the case where the process cartridge is detached from the image forming apparatus, under the condition that a developing region of each developing unit opposed to the image forming body is placed downward, toner can be supplied from an upper portion of the process cartridge through a supply port having a cover to open and close the supply port.

A cleaning unit having a used toner box is detachably provided in the process cartridge of the above color image forming apparatus. In the case where the process cartridge is horizontally detached from the color image forming apparatus, the used toner box can be horizontally removed from the cleaning unit of the process cartridge under the condition that the used toner box is not inclined.

The cleaning unit having the used toner box is detachably provided in the process cartridge of the above color image forming apparatus. Under the condition that the process cartridge is horizontally detached from the color image forming apparatus and inclined, the cleaning unit including the used toner box can be horizontally removed from the process cartridge.

In the color image forming apparatus, a process cartridge includes a belt-shaped photoreceptor disposed at least in a vertical direction which works as an image forming body, and also includes a plurality of developing units disposed in a vertical direction in parallel on a vertical surface of the belt-shaped photoreceptor, wherein the process cartridge can be attached to and detached from the color image forming apparatus. In this image forming apparatus, each developing unit is horizontally moved by a predetermined distance so that the developing unit can be exposed to the outside of the process cartridge and the color image forming apparatus. The toner supply port is provided in the exposed portion of the developing unit. Therefore, under the condition that the process cartridge is attached to the image forming apparatus, toner can be supplied to each developing unit. The color image forming apparatus is constructed in the above manner.

In the color image forming apparatus, a process cartridge includes a belt-shaped photoreceptor disposed at least in a vertical direction which works as an image forming body, and also includes a plurality of developing units of different sizes vertically disposed in parallel on a vertical surface of the belt-shaped photoreceptor, wherein the process cartridge can be horizontally attached to and detached from the color image forming apparatus. Toner supply ports of the plurality of developing units are arranged stepwise, and toner can be supplied to each toner supply port under the condition that the process cartridge is attached or moved horizontally. The color image forming apparatus is constructed in the above manner.

The color image forming apparatus is provided with a process cartridge which includes a belt-shaped photoreceptor, at least the straight portion of which is inclined, and also includes a plurality of developing units which are disposed in parallel along the straight inclined surface of the photoreceptor belt, each developing unit being horizontally disposed stepwise, wherein the process cartridge is detachably provided to the color image forming apparatus. When the cover of the developing unit of the color image forming apparatus is opened under the condition that the cartridge is attached and moved horizontally, toner can be supplied to the developing unit.

The second object of the present invention can be accomplished by a color image forming apparatus having a process cartridge in which an image forming body and a plurality of developing units are provided. In the process cartridge, a plurality of developing units are disposed on the side of the image forming body in parallel. When the process cartridge is rotated in a direction perpendicular to the rotational shaft of the image forming body so that the plurality of developing units are located below the image forming body, the process cartridge can be attached to and detached from the image forming apparatus. In the above image forming apparatus, when a developing cartridge accommodating the plurality of developing units is rotated in a direction perpendicular to the rotational shaft of the image forming body, the plurality of developing units and the image forming body can be replaced, and toner can be supplied to the plurality of developing units.

BRIEF DESCRIPTION OF THE DRAWINGS

FIG. 1(*b*) is a sectional front view of the process cartridge taken out from the image forming apparatus.

FIG. 1(*c*) is a sectional front view showing the process cartridge inclined by an angle of 90° compared with the condition illustrated in FIG. 1(*b*).

DETAILED DESCRIPTION OF THE INVENTION

Figure 1:
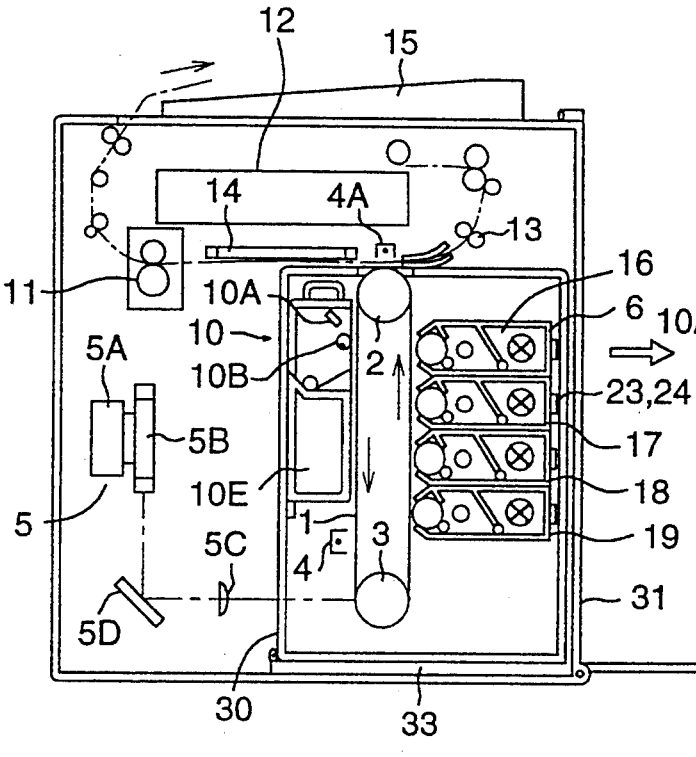
FIG. 1(*a*) is a sectional front view of the color image forming apparatus to which a process cartridge is provided.
Figure 1:
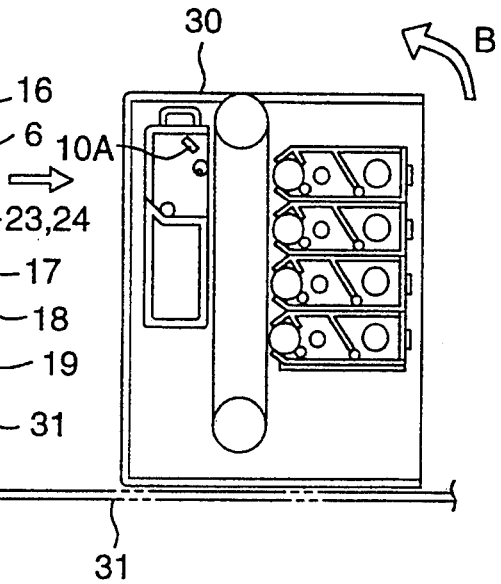
Figure 1:
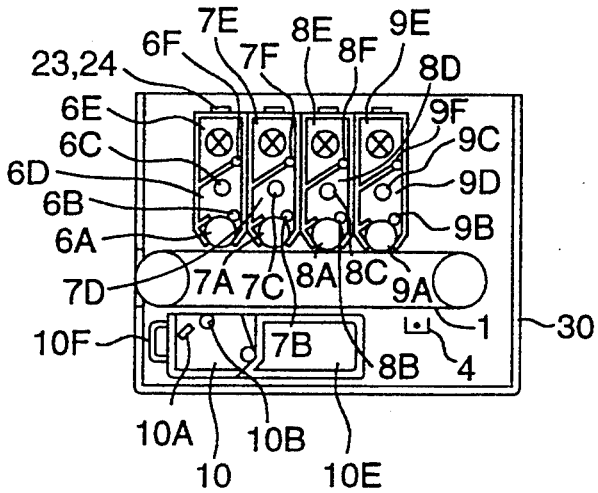

The color image forming apparatus to accomplish the first object of the present invention will be explained as follows. First, with reference to FIGS. 1(*a*) to 4, the color image forming apparatus of Example (1) will be explained here. In this connection, the operation is conducted on the right of this color image forming apparatus shown in the drawing, and the process cartridge can be attached to and detached from the apparatus on the right, and further toner can be supplied to the apparatus on the right.

FIGS. 1(*a*), 1(*b*) and 1(*c*) show an entire construction of the color image forming apparatus of Example (1), and also show the process cartridge located in various positions. In the drawings, numeral 1 is a flexible photoreceptor belt that is a belt-shaped image forming body. The photoreceptor belt 1 is vertically provided around rotational rollers 2 and 3, and when the rotational roller 2 is driven, the photoreceptor belt 1 is conveyed in the arrowed direction.

Numeral 4 is a charger, numeral 4A is a transfer electrode, numeral 5 is a laser writing unit, numerals 6 to 9 are developing units in which developer of a specific color is contained, numeral 10 is a cleaning unit, and numeral 11 is a fixing unit. The developing units 6, 7, 8, 9 are disposed in parallel along the circumferential surface of the photoreceptor belt 1. For example, developers of yellow, magenta, cyan and black are respectively contained in the developing units. The developing units are provided with developing sleeves 6A, 7A, 8A, 9A, and the gaps formed between the photoreceptor belt 1 and the developing sleeves are maintained to be a predetermined value, and a latent image on the photoreceptor belt 1 is visualized by the noncontact reversal developing method. Unlike the contact developing method, the noncontact reversal developing method is advantageous in that it does not interfere with the movement of the photoreceptor belt 1.

During the process of image formation, the blade 10A of the cleaning unit 10 is separated from the surface of the photoreceptor belt 1 by the action of the cam 10B, and only when the cleaning operation is carried out after image formation, the blade 10A comes into pressure contact with the surface of the photoreceptor belt 1 as illustrated in the drawing.

By the color image forming apparatus described above, color image formation is carried out in the following manner.

In this example, multicolor image formation is carried out according to the following image forming system. That is, an original image is scanned by an image sensor in a color data input section, and the obtained data is processed in an image data processing section so that image data is made. The image data is temporarily stored in an image memory. Then, the image data is taken out from the image memory in the process of recording, and the image data is inputted into a recording section, for example, the image data is inputted into the color image forming apparatus shown in the example in FIG. 1.

A color signal outputted from an image reading apparatus that is different from the aforementioned image forming apparatus, is inputted into the laser writing system unit 5. Then, in the laser writing system unit 5, a laser beam generated by a semiconductor laser (not shown) conducts a rotational scanning operation by the action of a polygonal mirror 5B rotated by a drive motor 5A. The laser beam passes through an f$\theta$ lens 5C, and the optical path of the laser beam is curved by a mirror 5D. Then, the laser beam is projected on the circumferential surface of the photoreceptor belt 1 onto which an electrical charge has been previously given by the charger 4, so that a bright line is formed on the circumferential surface of the photoreceptor belt 1.

When an image formation start signal is inputted into a control section, the electric power source (not shown) for charging the charger 4 is turned on and a charging voltage is impressed upon the photoreceptor belt 1. At this time, the electric power source for transfer is turned off.

On the other hand, when the scanning operation is started, the beam is detected by the index sensor, and the beam modulation is started by the first color signal, so that the modulated beam scans the circumferential surface of the photoreceptor belt 1. Accordingly, a latent image corresponding to the first color is formed on the circumferential surface of the photoreceptor belt 1 by the primary scanning and the auxiliary scanning, wherein the primary scanning is conducted by the laser beam, and the auxiliary scanning is conducted by the conveyance of the photoreceptor belt 1. The formed latent image is reversal-developed by the developing unit 6 loaded with yellow (Y) toner under the noncontact condition, so that a toner image is formed on the belt surface. The toner image on the belt passes under the cleaning unit 10 separated from the circumferential surface of the photoreceptor belt 1. Then, the process advances to the successive copy cycle.

The photoreceptor belt 1 is charged again by the charger 4, and then the second color signal outputted from the signal processing section is inputted into the laser writing system unit 5. In the same manner as the first color signal, the writing operation is conducted on the belt surface, so that a latent image is formed. The formed latent image is reversal-developed by the developing unit 7 loaded with magenta (M) toner under the noncontact condition.

The magenta (M) toner image is formed in the presence of the yellow (Y) toner image that has already been formed.

Numeral 8 is a developing unit loaded with cyan (C) toner. By the developing unit 8, a cyan (C) toner image is formed on the belt surface in accordance with a control signal generated by the signal processing section.

Numeral 9 is a developing unit loaded with black toner. In the same manner as described above, a black toner image is formed in registration on the belt surface. A DC and/or an AC bias voltage is impressed upon each developing sleeve of the developing units 6, 7, 8, 9 and the jumping development operation is carried out by one-component or two-component developer so that the image on the photoreceptor belt 1 is reversal-developed under the noncontact condition.

In the manner described above, a color toner image is formed on the circumferential surface of the photoreceptor belt 1 while it is rotated by 4 revolutions. The color toner image is transferred by the action of the transfer electrode 4A onto a transfer sheet sent from the paper feed cassette 12 and conveyed by the timing roller 13.

Synchronously with the drive signal for the timing roller 13 sent from the control section, the electric power source for transfer is switched on, so that a transfer voltage is impressed upon the transfer sheet, and the toner image is transferred onto the transfer sheet from the photoreceptor belt 1. At this time, the electric power source for charging is switched off.

After the toner image has been transferred onto the transfer sheet, the transfer sheet is separated from the circumferential surface of the photoreceptor belt 1 and conveyed by the conveyance belt 14 having an attracting function. After that, the toner image is fixed by the fixing unit 11, and then the transfer sheet is discharged onto a tray 15.

After the transfer sheet has been separated from the photoreceptor belt 1, the photoreceptor belt 1 starts the fifth revolution in which the blade 10A of the cleaning unit 10 is brought into pressure contact with the photoreceptor belt 1 by the action of the cam 10B so that the residual toner is removed and the belt surface is cleaned. Then, the photoreceptor belt 1 is charged again by the charger 4 and enters the successive image forming process.

Numerals 16, 17, 18, 19 are toner accommodating hoppers for accommodating toner to be supplied to the developing units 6, 7, 8, 9. The toner accommodating hoppers 16, 17, 18, 19 are respectively integrated with the developing units 6, 7, 8, 9.

A toner supply port 23 is provided to each of the toner accommodating hoppers 16, 17, 18, 19. As illustrated in the drawing, the toner supply port 23 is provided with a cover 24, which is closed at ordinary times.

The developing units 6, 7, 8, 9 and toner accommodating hoppers 16, 17, 18, 19 are integrally assembled to the process cartridge 30 together with the photoreceptor belt 1, charger 4 and cleaning unit 10 as described before.

As illustrated in FIGS. 1(*a*), 1(*b*), 1(*c*), a fore end of the cleaning blade 10A of the cleaning unit 10 is pushed to the image formation belt (photoreceptor belt) 1 with a predetermined force. However, while the photoreceptor belt 1 is rotated by 5 times for development, the fore end of the blade 10A is separated from the surface of the photoreceptor belt 1 by the action of the cam 10B. When the photoreceptor belt 1 is cleaned, the fore end of the blade 10A comes into contact with the surface of the belt 1 for cleaning. In this way, the next development operation cycle is ready.

The cleaning unit 10 is provided with a used toner box 10E in which the toner removed from the photoreceptor 1 surface is accommodated.

In the manner described above, the used toner removed by the cleaning unit 10 is positively collected into the used toner box 10E. Therefore, the used toner does not scatter inside the process cartridge and image forming apparatus, so that they are not stained with toner.

As illustrated in FIGS. 1(*a*), 1(*b*), when a cover 31 on the side of the apparatus is open, the process cartridge 30 can be moved to the right along guide rails 33.

When two-component developer is applied to this example, the operations are conducted in the following manner:

The developing units 6, 7, 8, 9 having the toner accommodating hoppers 16, 17, 18, 19 are used as shown in detail in FIG. 1(*c*). Toner is supplied to each of the toner hoppers 16, 17, 18, 19 of the developing units when the toner supply cover is opened. The supplied toner enters the toner reservoirs 6E, 7E, 8E, 9E. After that, in accordance with a change in toner concentration in the developing tanks 6D, 7D, 8D, 9D, the toner supply rollers 6F, 7F, 8F, 9F are rotated, and the toner is conveyed into the developing tanks 6D, 7D, 8D, 9D. When the stirring members 6C, 7C, 8C, 9C are activated, the toner is uniformly mixed with carrier. After that, the mixed toner is supplied to the developing sleeves 6A, 7A, 8A, 9A by the developer supply rollers 6B, 7B, 8B, 9B.

It should be noted that the present invention is not limited to two-component developer. In the case of one-component developer, almost the same type developing unit as that of this example may be used. After toner has been supplied through the opened toner supply cover 24, toner is directly conveyed into the developing tanks 6D, 7D, 8D, 9D in accordance with the consumption of toner. Then the new and old toners are uniformly stirred by the action of the stirring members 6C, 7C, 8C, 9C. After that, the toner is supplied onto the developing sleeves 6A, 7A, 8A, 9A.

Figure 2:
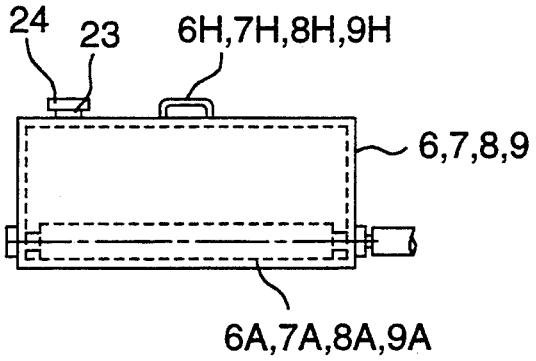
FIG. 2 is a sectional side view of the developing unit.

As illustrated in FIG. 1(*c*), in Example (1), the operations are carried out in the following manner:

The process cartridge 30 is pulled out from the color image forming apparatus and inclined by an angle of 90°. Then, as illustrated in the sectional front view of FIG. 1(*c*) and the side view of FIG. 2, the cover 24 of an arbitrary developing unit is opened so as to supply a predetermined toner from the toner supply port 23. In this construction, units are appropriately arranged so that toner is not spilt from the cleaning unit.

Figure 4:
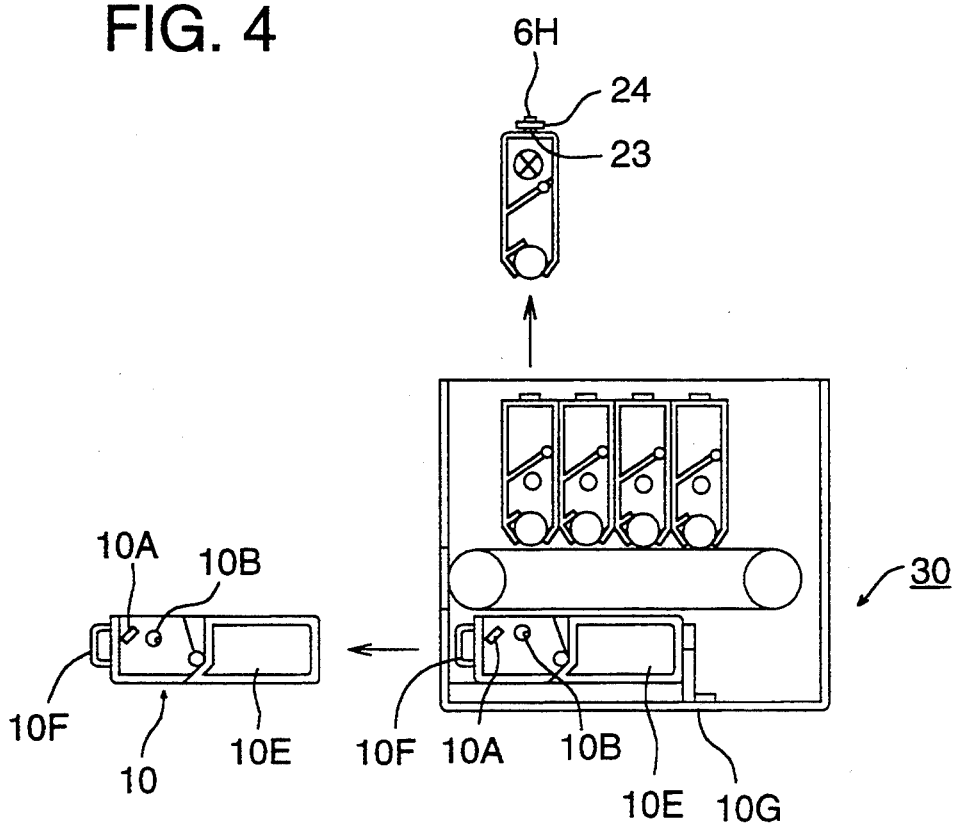
FIG. 4 is a sectional front view showing a condition in which the cleaning unit is taken out horizontally below the process cartridge under the condition illustrated in FIG. 1(*c*), and also showing a condition in which the developing unit is taken out above the process cartridge.

In Example (1) shown in FIG. 4, the used toner is removed and the cleaning unit 10 is inspected and maintained in the following manner:

The process cartridge 30 is pulled out from the apparatus and laid down. Then the process cartridge 30 is drawn by the handle 10F along the rails 10G. After that, the used toner in the used toner box 10E is processed, and at the same time the cleaning unit 10 is inspected and cleaned. As explained above, according to this construction, the cleaning unit 10 can be positively drawn out along the rails 10G without coming into contact with the photoreceptor surface. Further, an arbitrary developing unit among the developing units 6, 7, 8, 9 can be taken out upward so that the maintenance can be easily performed.

Figure 3:
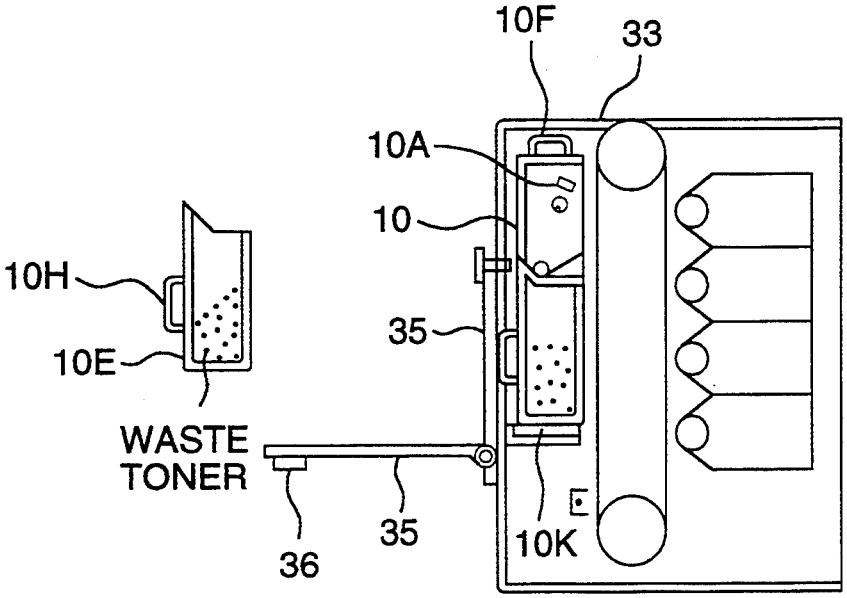
FIG. 3 is a sectional front view showing a condition in which the used toner hopper is horizontally taken out under the condition illustrated in FIG. 1(*b*).

According to Example (1) shown in the sectional front view of FIG. 3, the clamp 36 of the cover 35 is released so that the cover 35 is opened, and only the used toner box 10E of the cleaning unit 10 is horizontally moved along the rails 10K when the handle 10H is pulled by an operator. Of course, toner can be supplied in the same manner as that shown in FIG. 1(*c*).

Next, with reference to FIG. 5, which is a sectional front view of the color image forming apparatus, Example (2) will be explained as follows.

The construction of this example is approximately the same as that shown in FIG. 1(*a*)–1(*c*). However, in this example, the toner supply port 23A of each of the developing units 6, 7, 8, 9 is disposed upward, and the cover 24A can be opened. When the cover 31 of the image forming apparatus is opened under the condition that the process cartridge 30 is disposed in the image forming apparatus, only an arbitrary developing unit is pulled out to the right when one of the handles 6H, 7H, 8H, 9H is pulled. Under the above condition, the aforementioned cover 24A is opened so as to supply toner. After toner has been supplied into the developing unit, it is returned to the left to a predetermined position in the process cartridge 30, so that the operations can be continued. As described above, in this example, it is not necessary to move the heavy process cartridge.

In this example, of course, the process cartridge 30 may be taken out to the right from the apparatus along the rails 33 for the purpose of inspection and maintenance. Also, the developing unit may be taken out from the process cartridge for inspection, maintenance and replacement.

Figure 6:
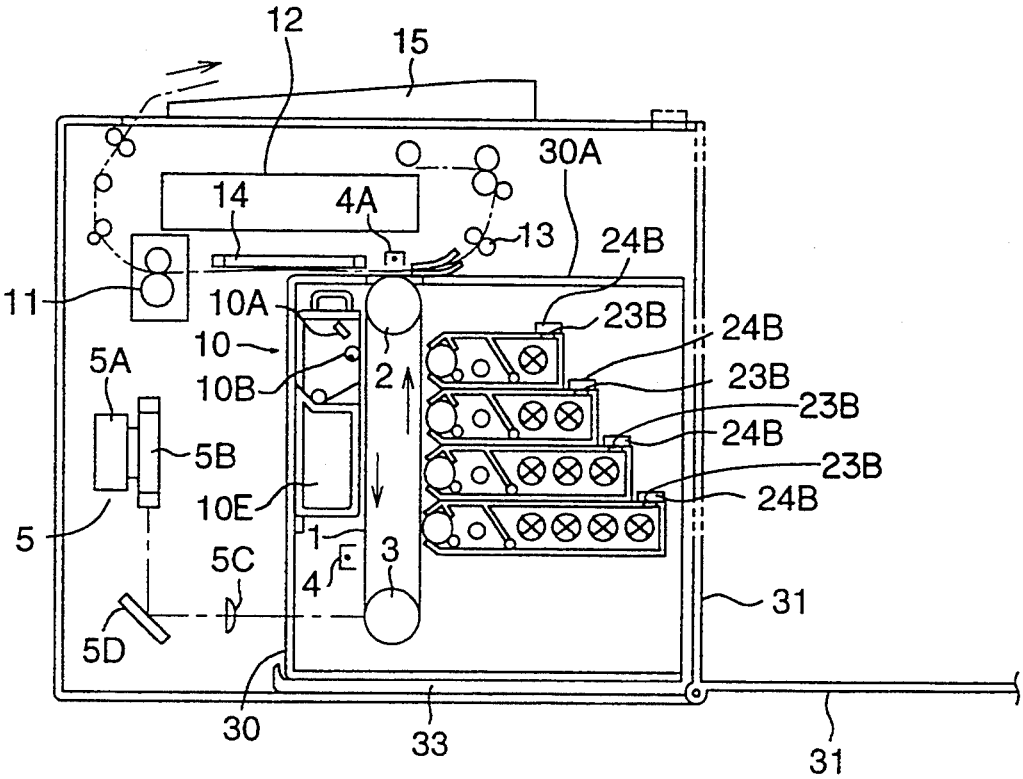
FIG. 6 is a sectional front view showing a condition in which the toner supply ports of the developing units of the process cartridge are disposed stepwise so that they are directed upward, and toner is supplied while the process cartridge is attached to the image forming apparatus.

Next, with reference to FIG. 6, which is a sectional front view of the color image forming apparatus, Example (3) will be explained as follows.

Figure 5:
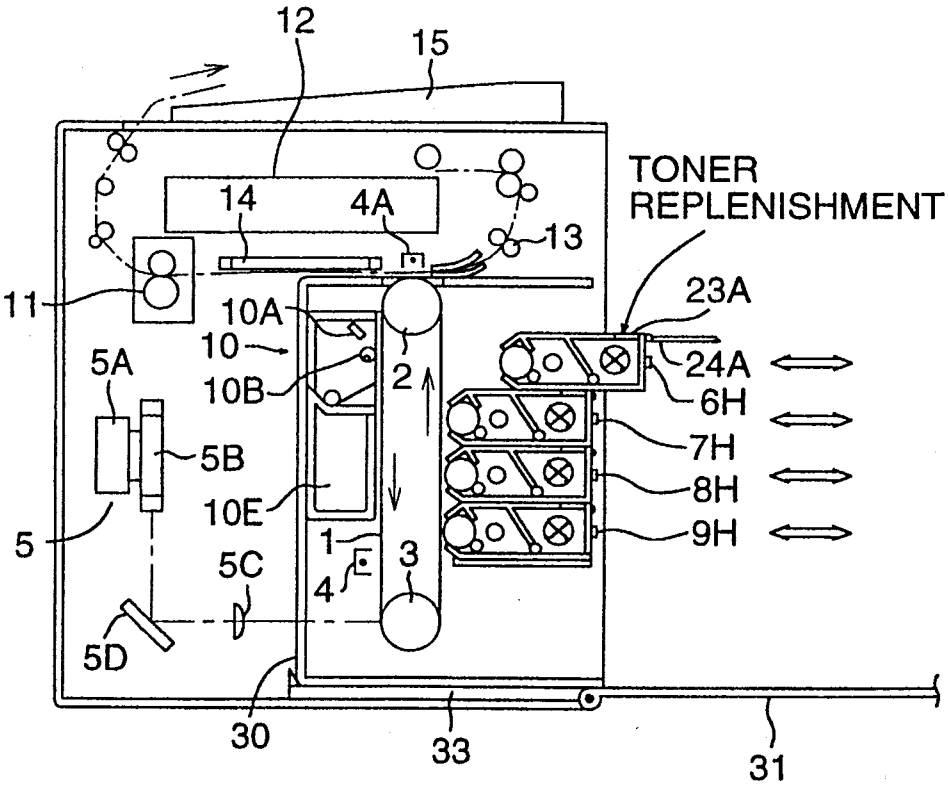
FIG. 5 is a sectional front view showing a condition in which an arbitrary developing unit is taken out from the process cartridge for supplying toner under the condition that the process cartridge is attached to the image forming apparatus.

In the example illustrated in FIG. 5, the developing units of the same size are used. On the other hand, in this example illustrated in FIG. 6, the developing units of different sizes are used. As illustrated in FIG. 6, the size of the developing unit is increased as it goes downward. The toner supply port 23B of each toner hopper is disposed upward when the developing unit is attached to the apparatus, and the cover 24B is mounted on the toner supply port 23B. A large cutout portion 30A is formed in an upper portion of the process cartridge 30. Therefore, when the cover 31 of the image forming apparatus is opened, under the condition that the process cartridge 30 is provided in the apparatus, the cover 24B of an arbitrary developing unit is opened so that toner can be easily supplied from a toner supply device.

Of course, the process cartridge 30 may be pulled out along the rails 33 in order to supply toner or to inspect and maintain the cartridge.

Finally, with reference to FIG. 7, which is a sectional front view of the color image forming apparatus, Example 4 will be explained as follows.

As illustrated in the drawing, the construction of this example is characterized as follows:

A straight conveyance portion of the belt-shaped photoreceptor 1 is disposed diagonally. Along the inclined surface of the belt-shaped photoreceptor 1, four developing units of the same size are provided, in which the toner supply port 23C is disposed upward. As illustrated in FIG. 7, the toner supply ports 23C of the four developing units are disposed stepwise. This construction is advantageous in that: toner is seldom spilt from the cleaning unit; and the developing units of the same size can be applied, which is different from the apparatus shown in FIG. 6.

A large cutout portion 30A is formed in an upper portion of the process cartridge 30 for supplying toner.

Figure 7:
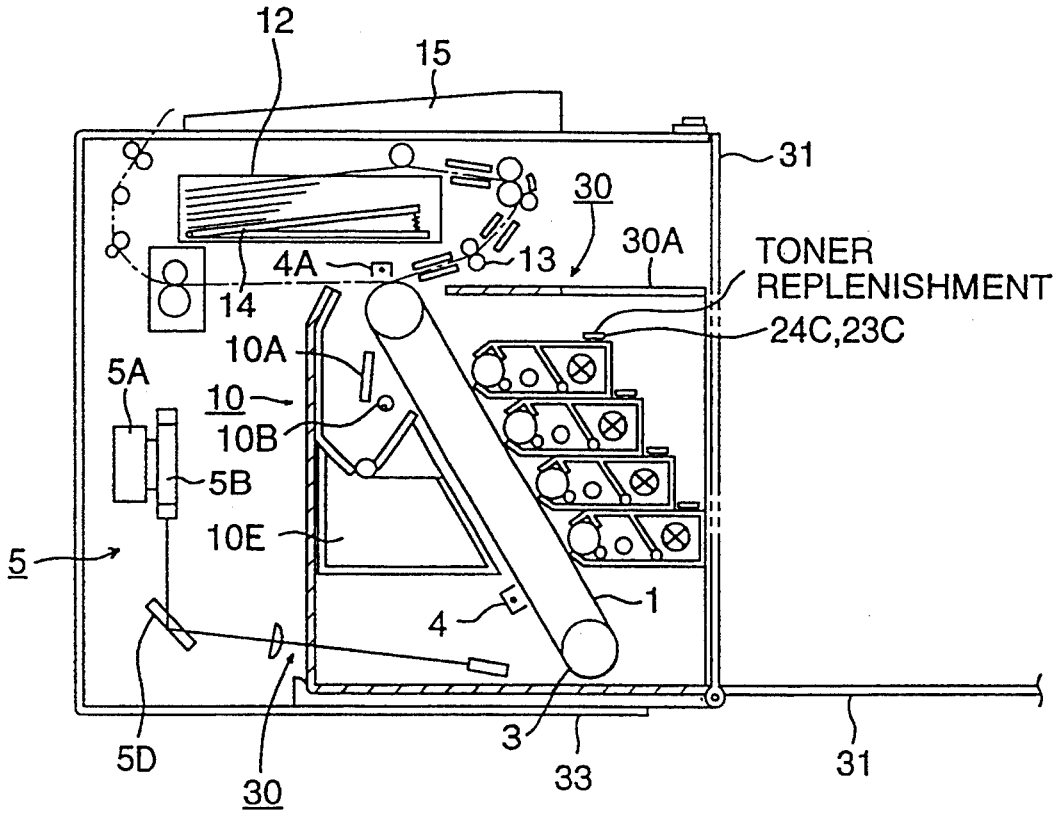
FIG. 7 is a sectional front view of the color image forming apparatus to which the process cartridge is attached, in which the developing units are disposed stepwise along the inclined belt-shaped photoreceptor.

As illustrated in FIG. 7, when the cover 31 is opened under the condition that the process cartridge 30 is provided in the color image forming apparatus, the cover 24C of the toner supply port 23C is removed. Then a toner supply device is connected with the toner supply port 23C so that toner can be supplied.

After the completion of supply of toner, each cover 24C is set, and further the cover 31 is closed so that the operations can be started again. Of course, the process cartridge may be pulled out from the apparatus for supplying toner or conducting inspection and maintenance.

According to the present invention, the developing unit and cleaning unit of the process cartridge composing the color image forming apparatus is safely pulled out from the apparatus so that toner can be supplied, used toner can be efficiently processed and maintenance can be easily conducted. Further, the process cartridge can be removed from the main body of the apparatus. Therefore, the entire color image forming apparatus can be easily inspected and maintained.

Further, according to the present invention, while the process cartridge is attached to the image forming apparatus, an arbitrary developing unit is slid so that the toner supply port can be exposed so as to supply toner to the developing unit. Furthermore, while the developing units are provided in the apparatus as well as the process cartridge, toner can be easily supplied when some of the covers are removed or the process cartridge is pulled out.

In order to accomplish the second object of the present invention, Example (5) of the color image forming apparatus will be explained with reference to FIGS. 8 to 11.

Numeral 101 is a photoreceptor drum, on the circumferential surface of which an OPC photoreceptor is provided. When the rotational shaft A is driven, the photoreceptor drum is rotated in a direction indicated by the arrow in the drawing. Numeral 102 is a charger which gives an electric potential onto the photoreceptor drum 101. Numeral 103 is a laser writing unit comprising a drive motor 103A; a polygonal mirror 103B; a F$\theta$ lens 103C; and a mirror 103D which is an exposure means of document images. Numerals 104 to 107 are developing units respectively accommodating toner of a specific color.

Not only the optical system illustrated in the drawing but also an optical system in which a light emitting section and a convergence type photoconductor are integrated into one body, is used for the laser writing system unit 103.

For example, the above developing units 104, 105, 106 respectively accommodate yellow, magenta, cyan and black developers. They are provided with developing sleeves 104A, 105A, 106A, 107A, whereby a predetermined gap is formed between the photoreceptor drum 101 and the developing sleeves 104A, 105A, 106A, 107A. The developing sleeves 104A, 105A, 106A, 107A have the function to make a latent image on the photoreceptor drum visual by the method of non-contact development. Unlike the contact developing method, this non-contact developing method is advantageous in that the movement of the photoreceptor drum 101 is not obstructed.

Numeral 115 is a transfer drum. Numeral 108 is a cleaning unit. A blade 108A of the cleaning unit 108 comes into pressure contact with the surface of the photoreceptor drum 101.

This image forming apparatus is a transfer type image forming apparatus which forms a color image when a mono-color toner image formed on the circumferential surface of the photoreceptor drum 101 is transferred each time the latent image is developed.

A color image formation process of the above color image forming apparatus is carried out in the following manner.

In the same manner as that of the color image forming apparatus shown in FIG. 1(*a*)–1(*c*), a latent image of the first color is formed on the circumferential surface of the photoreceptor drum 101 by the primary scanning conducted by the laser beam of the laser writing system unit, and also by the subsidiary scanning conducted by the rotation of the photoreceptor drum 101. The formed latent image is developed by the developing unit 104 in which yellow (Y) toner is loaded, so that a toner image is formed on the surface of the photoreceptor drum 101.

While the toner image is being formed in the above manner, only an uppermost transfer sheet in the sheet cassette 111 is conveyed out by the conveyance roller 112 and the double feed prevention roller 113. The transfer sheet is conveyed to the transfer drum 115 by the sheet feed roller 114, and a fore end of the transfer sheet is clamped by the clamping claw 115A so that the transfer sheet is wound around the circumferential surface of the transfer drum 115.

The first toner image formed in the above manner is transferred onto the transfer sheet on the transfer drum 115 rotated synchronously with the photoreceptor drum 101. After the residual toner has been removed by the cleaning unit 108, the next image formation cycle is started.

In the successive image formation cycle, the photoreceptor drum 101 is charged again by the charger 102. Then the second color signal outputted from the signal processing section is inputted into the writing system unit 103, and in the same manner as that of the first color signal described above, an image signal is written on the surface of the photoreceptor drum 101 so that a latent image can be formed. The formed latent image is developed by the developing unit 105 in which the second color toner of magenta (M) is loaded.

The thus obtained second toner image is also transferred onto the transfer drum 115 in the same manner as that of the first toner image, so that the second toner image is superimposed on the first toner image. After the transfer of the second image, the residual toner is removed by the cleaning unit 108.

That is, this magenta (M) toner image is transferred in the presence of the yellow (Y) toner image which has already been formed.

Numeral 106 is a developing unit having cyan (C) toner. In accordance with a control signal generated in the signal processing section, a toner image of cyan (C) is formed on the surface of the photoreceptor drum 101.

Numeral 107 is a developing unit having black toner. In accordance with a control signal generated in the signal processing section, a black toner image is formed on the surface of the photoreceptor drum 101 in the same manner. A DC or AC bias is impressed upon each sleeve of the developing units 104, 105, 106, 107, so that the toner image is subjected to what is called jumping development in which 2-component developer is used. With respect to the photoreceptor drum 101, the base of which is grounded, reversal development is carried out under the non-contact condition. In this connection, non-contact development in which one-component developer is used may be applied.

As described above, the color toner image is transferred onto the transfer sheet. Then the transfer sheet is disengaged from the clamping claw 115A by the action of the separation claw 115B. Then the toner image on the transfer sheet is fixed by the fixing unit 116. After that, the transfer sheet is discharged onto the tray 118 on the apparatus through the discharging roller 117.

The photoreceptor drum 101 and the developing units 104, 105, 106, 107 disposed in parallel on the side of the photoreceptor drum 101 are integrally assembled to the process cartridge C1 together with the charger 102 and the cleaning unit 108. The process cartridge C1 is detachably supported by a pair of guide rails G fixed on the inner surface of the side cover 110.

Figure 9:
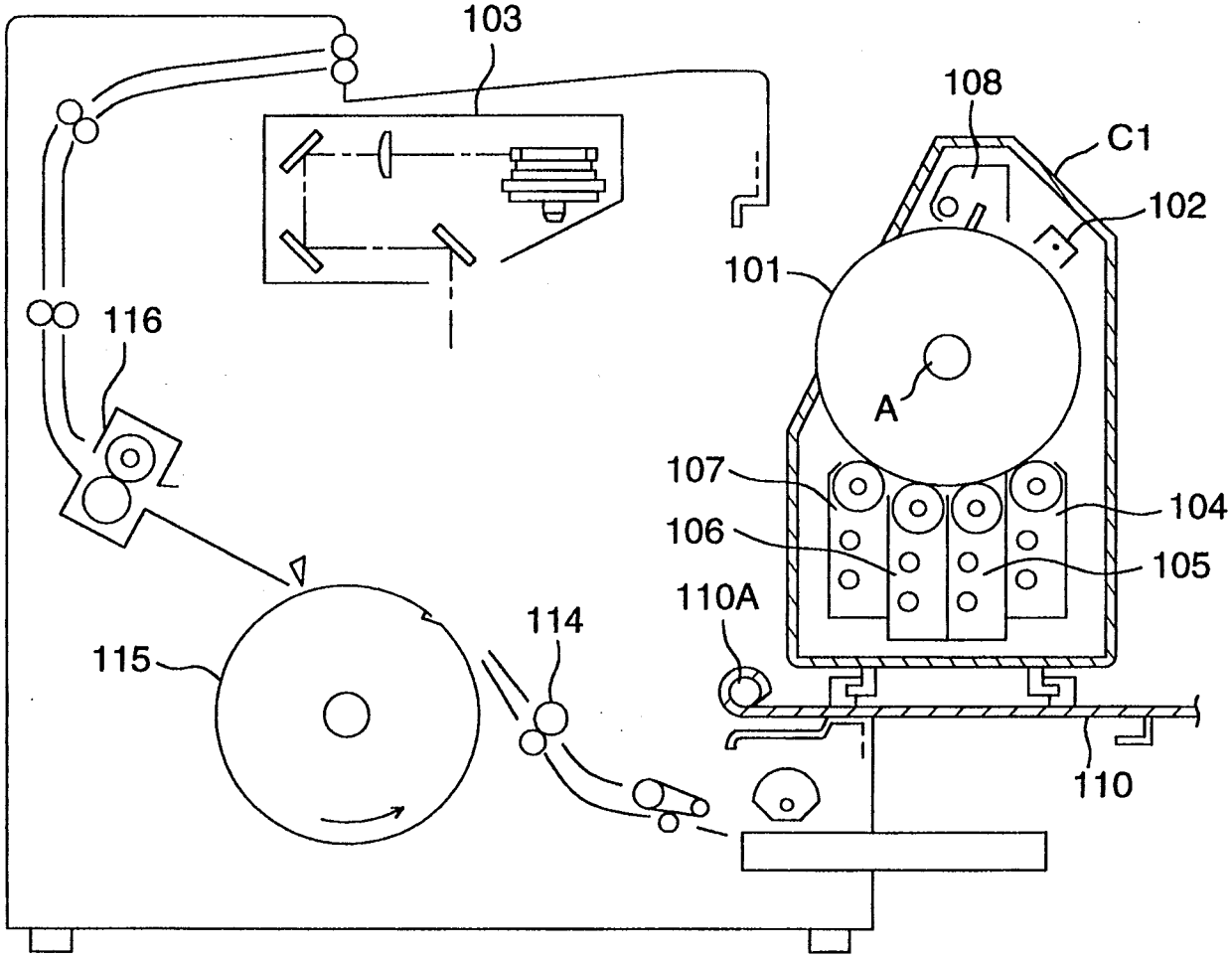
FIG. 9 is a sectional view showing the construction of the device described above in the case where the process cartridge is rotated.

When the side cover 110 is rotated clockwise around the support shaft 110A by an angle of 90°, the side of the apparatus is opened as illustrated in FIG. 9. Concurrently, the process cartridge C1 is rotated in a direction perpendicular to the rotational shaft A of the photoreceptor drum 101, so that the developing units can be placed under the photoreceptor drum 101 as illustrated in FIG. 9.

As a result of the foregoing, the conveyance surface of the transfer sheet is opened, so that jam clearance can be easily carried out. Further, each developing unit is maintained at a posture in which toner leakage can be avoided. Accordingly, the process cartridge C1 can be safely attached to and detached from the apparatus.

Toner is supplied to each developing unit in the following manner.

Figure 10:
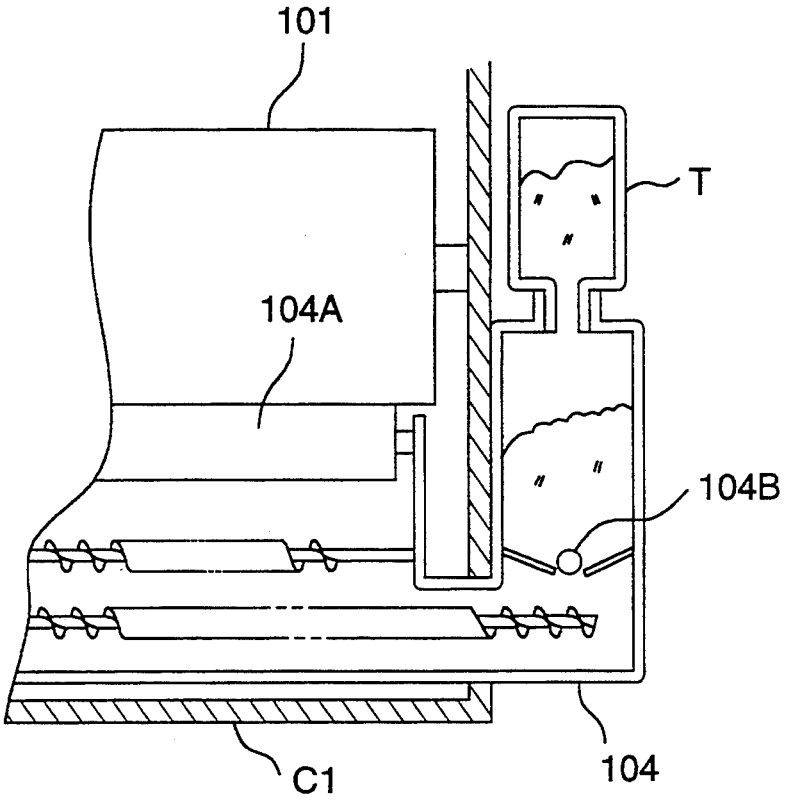
FIG. 10 is a sectional view of a primary portion showing the supply of toner to the developing unit into which the toner hopper is integrated.

In the case where the toner hopper is integrally connected with each developing unit on a back surface of the process cartridge C1 as illustrated in FIG. 10, the process cartridge C1 is placed in a condition shown in FIG. 9, and the toner cartridge T is attached to the developing unit 104 so as to supply yellow toner. Then, in accordance with a change in image density, the supply roller 104B is driven so that toner can be supplied into the developing unit 104.

Figure 11:
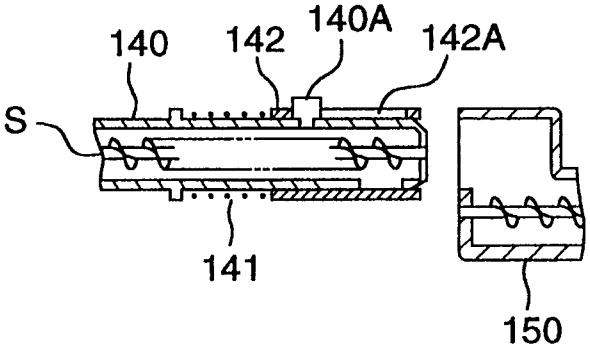
FIG. 11(*a*)–11(*b*) are sectional views showing a primary portion of the supply of toner to the developing unit in which the toner hopper is separately provided.
Figure 11:
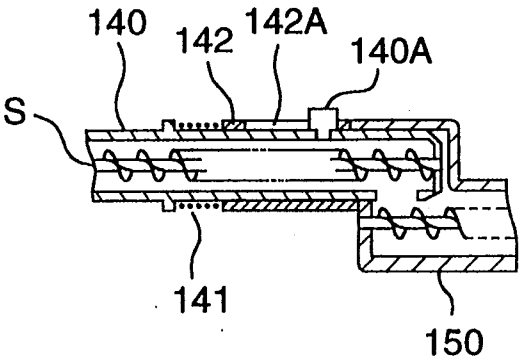

In the case where the toner hopper is fixed to the apparatus, a connection device is provided between the supply pipe 140 on the toner hopper side and the supply pipe 150 on the developing unit side as illustrated in FIG. 11(*a*), so that the supply pipe 140 can be attached to and detached from the supply pipe 150 when the process cartridge C1 is moved.

Figure 8:
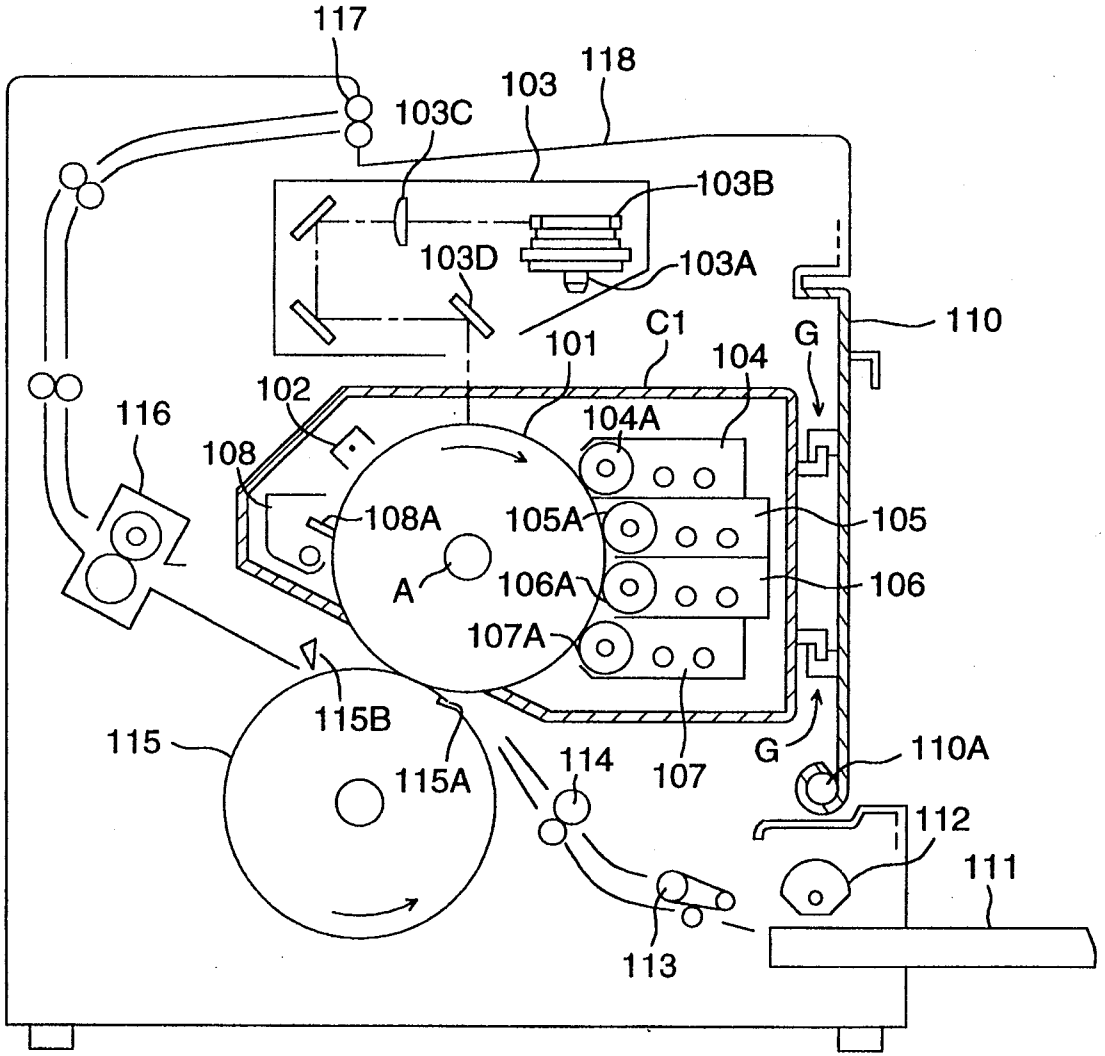
FIG. 8 is a sectional view showing the construction of an image transfer type color image forming apparatus.

The connection is established in the following manner: At the fore end of the supply pipe 140 on the toner hopper side, a sleeve 142 pushed by a compression spring 141 is attached. In the case where the process cartridge C1 is located at a position in the image forming apparatus as illustrated in FIG. 8, the supply pipe 150 connected with the developing unit pushes the sleeve 142 as illustrated in FIG. 11(*a*) so that the sleeve 142 is withdrawn. In this way, the supply pipe 150 is connected with the supply pipe 140 on the toner hopper side.

Consequently, when the conveyance screws S on both sides are driven, toner is supplied to the developing unit from the toner hopper.

When the process cartridge C1 is rotated to a position shown in FIG. 9, the supply pipe 150 on the developing unit side is withdrawn. Accordingly, as illustrated in FIG. 11(*b*), the sleeve 142 moves an end portion of the groove 142A until it comes into contact with the pin 140A by the action of the compression spring 141. As a result of the foregoing, a toner dropping hole of the supply pipe 140 is closed, and the supply pipe 140 is separated from the supply pipe 150.

Concerning the supply pipe 150 on the developing unit side, its opening portion is set upwardly when the process cartridge C1 is rotated. Accordingly, toner can be prevented from scattering.

Figure 12:
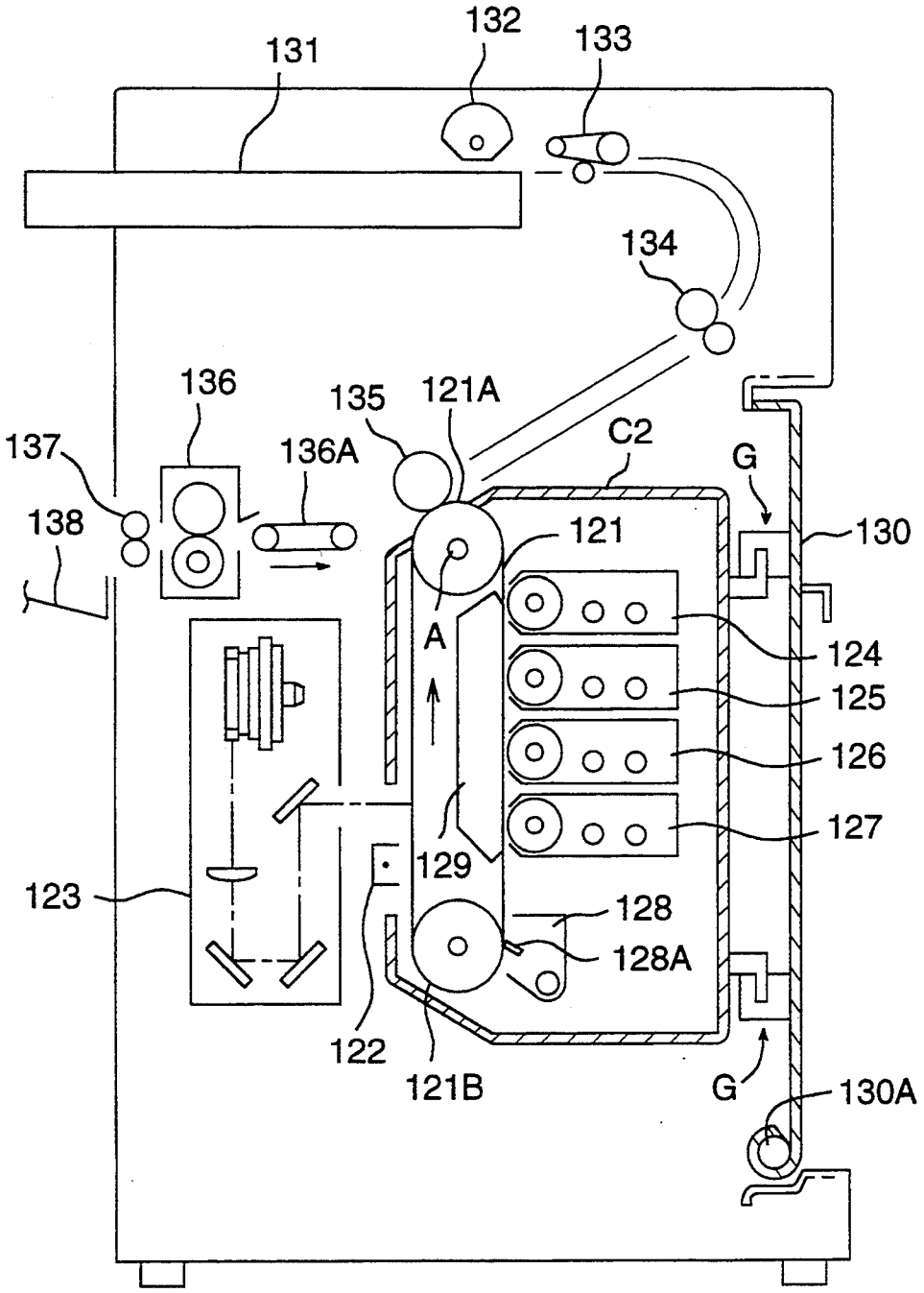
FIG. 12 is a sectional view showing the construction of an image superimposition type color image forming apparatus.
Figure 13:
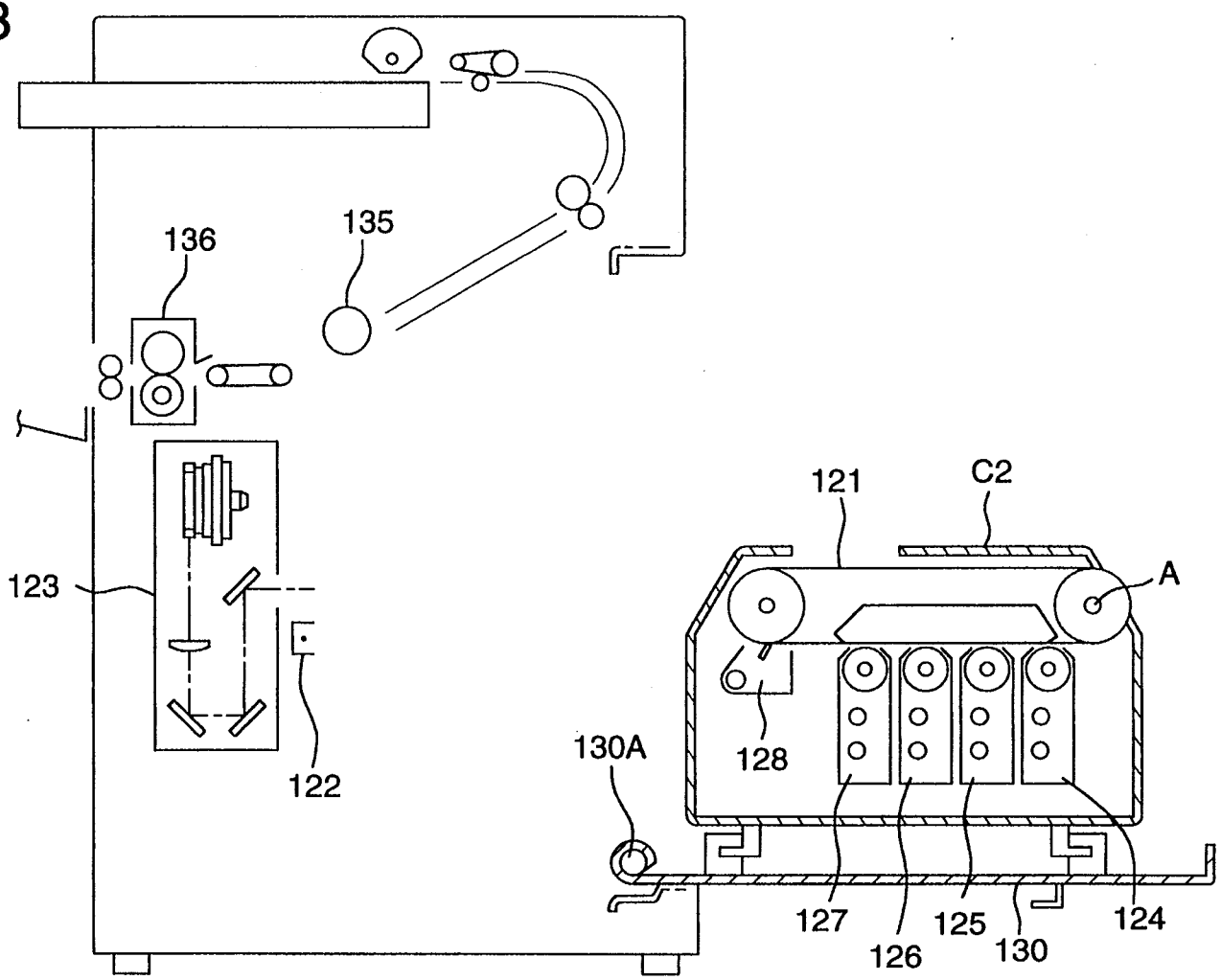
FIG. 13 is a sectional view showing the construction of the above apparatus in the case where the process cartridge is rotated.

Referring to FIGS. 12 and 13, Example (6) of the color image forming apparatus to accomplish the second object will be explained as follows.

In FIG. 12, numeral 121 is a flexible OPC photoreceptor belt which is a belt-shaped image forming body. The photoreceptor belt 121 is provided between rotational rollers 121A and 121B which are disposed at upper and lower positions. When the rotational roller 121A is driven, the photoreceptor belt 121 is conveyed clockwise.

Numeral 129 is a supporting member, that is, a guide member fixed to the apparatus in such a manner that the guide member 129 internally touches the photoreceptor belt 121. An inner circumferential surface of the photoreceptor belt 121 slides on the guide member 129 so that the photoreceptor belt 121 can be maintained in a tense condition.

Consequently, the positional relation between the photoreceptor on the outer circumferential surface of the photoreceptor belt 121 and the surface of the guide member 129 can be maintained constant even while the photoreceptor belt 121 is being conveyed. As a result, a stable image formation surface can be provided.

This apparatus is of an image superimposition type in which mono-color toner images are superimposed on the circumferential surface of the photoreceptor belt 121, and the superimposed image is transferred onto a transfer sheet so as to obtain a color image.

In the same process as that of Example (5), the image forming operations are carried out as follow:

A yellow toner image is formed on the photoreceptor belt 121 by the charger 122, laser writing system unit 123 and developing unit 124 accommodating yellow toner, wherein yellow is the first color. In the second rotation of the photoreceptor belt 121, a magenta toner image is formed on the yellow toner image, wherein magenta is the second color. In the same manner, in the third and fourth rotations of the photoreceptor belt 121, cyan and black toner images are superimposed so that a color toner can be formed, wherein cyan is the third color and black is the fourth color. During the above toner image formation, the blade 128A of the cleaning unit 128 is maintained at a position separate from the circumferential surface of the photoreceptor belt 121.

Synchronously with the color toner image formation, a transfer sheet is sent from the sheet cassette 131 through conveyance roller 132, double feed prevention roller 133 and sheet feed roller 134, and the toner image is transferred onto the transfer sheet by the action of the transfer roller 135. After transfer, the transfer sheet is conveyed to the fixing unit 136 through the conveyance belt 136A. After the fixing operation has been completed, the transfer sheet is discharged onto the discharge sheet tray 138 by the discharging roller 137.

After the transfer operation has been completed, in the fifth rotation, the photoreceptor belt 121 comes into pressure contact with the blade 128A of the cleaning unit 128 so that the residual toner on the photoreceptor belt 121 is removed. In this way, the photoreceptor belt 121 is ready for the next copy cycle.

The photoreceptor belt 121 and the developing units 124, 125, 126, 127 disposed in parallel on the side of the photoreceptor belt 121 are integrally assembled to the process cartridge C2 together with the cleaning unit 128. The process cartridge C2 is detachably supported by a pair of guide rails G fixed on the inner surface of the side cover 130.

Consequently, in the same manner as that of Example (5), when the side cover 130 is rotated around the shaft 130A so that it is opened as illustrated in FIG. 13, each developing unit can be placed at a lower position of the photoreceptor belt 121. In this way, each developing unit can be maintained in a posture in which the toner does not flow out.

With reference to FIGS. 14 to 17, Examples (7) and (8) of the color image forming apparatus to accomplish the second object will be explained as follows.

Figure 14:
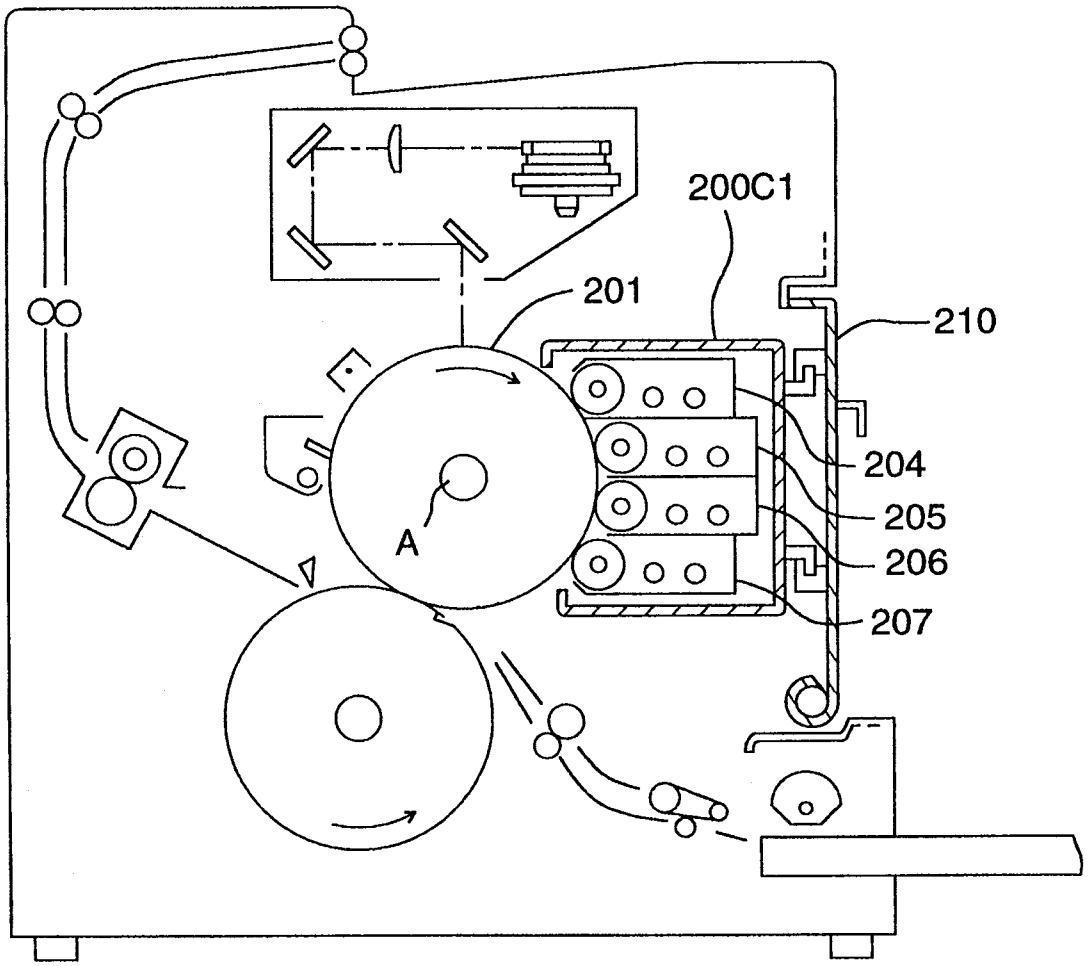
FIG. 14 is a sectional view showing the construction of an image transfer type color image forming apparatus.
Figure 15:
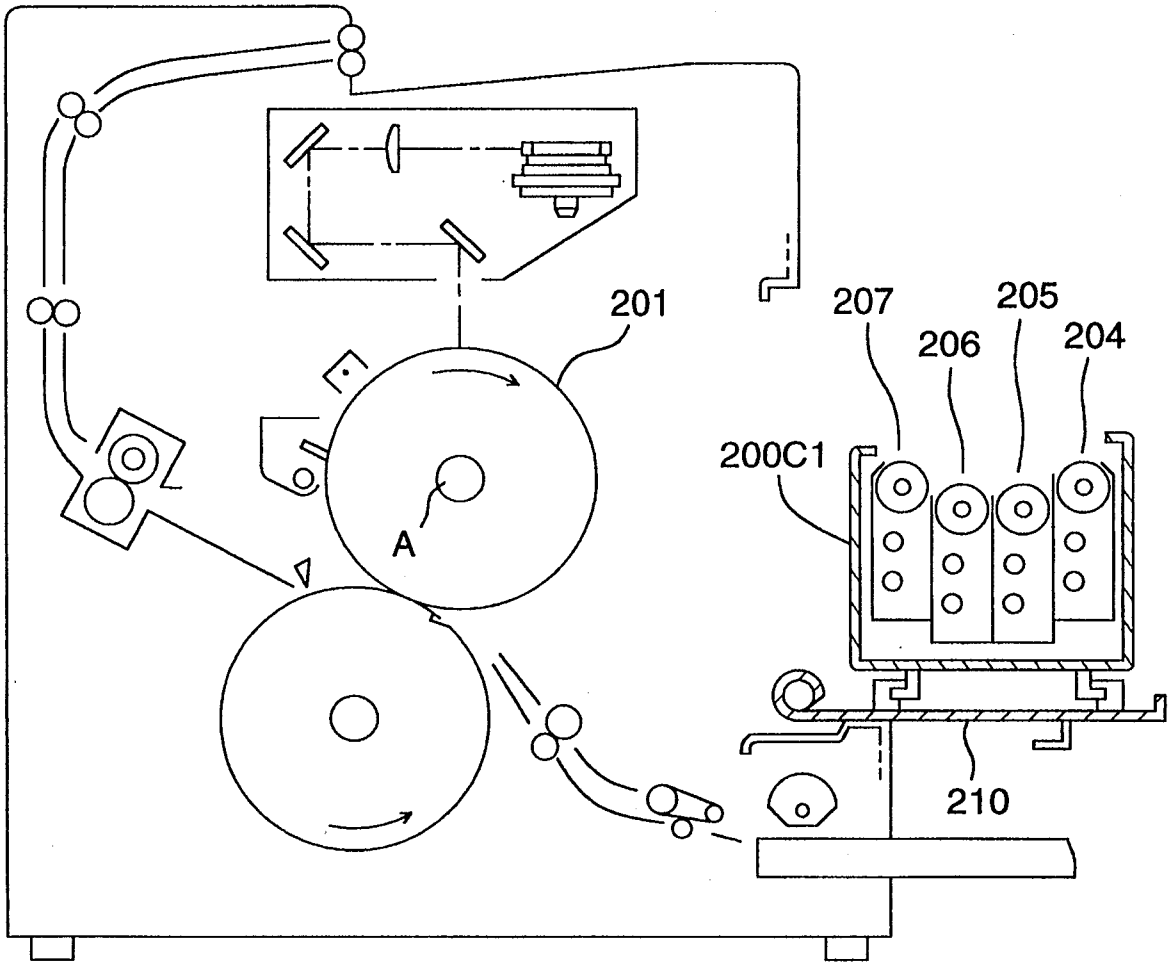
FIG. 15 is a sectional view showing the construction of the above apparatus in the case where the development cartridge is rotated.

FIGS. 14 and 15 show a transfer type color image forming apparatus. The developing units 204, 205, 206, 207 are integrally assembled to the development cartridge 200C1. The development cartridge 200C1 is detachably supported on the inner surface of the side cover 210 of the apparatus.

When the side cover 210 is opened, the developing units are integrally rotated in a direction perpendicular to the rotational shaft A of the photoreceptor drum 201 as illustrated in FIG. 15. Therefore, the developing units are withdrawn from the photoreceptor drum 201 and held in an upward condition.

Under the condition described above, the development cartridge 200C1 is removed, and the developing units are individually replaced, or the entire development cartridge is replaced. Further, when necessary, the photoreceptor drum 201 can be replaced.

Figure 16:
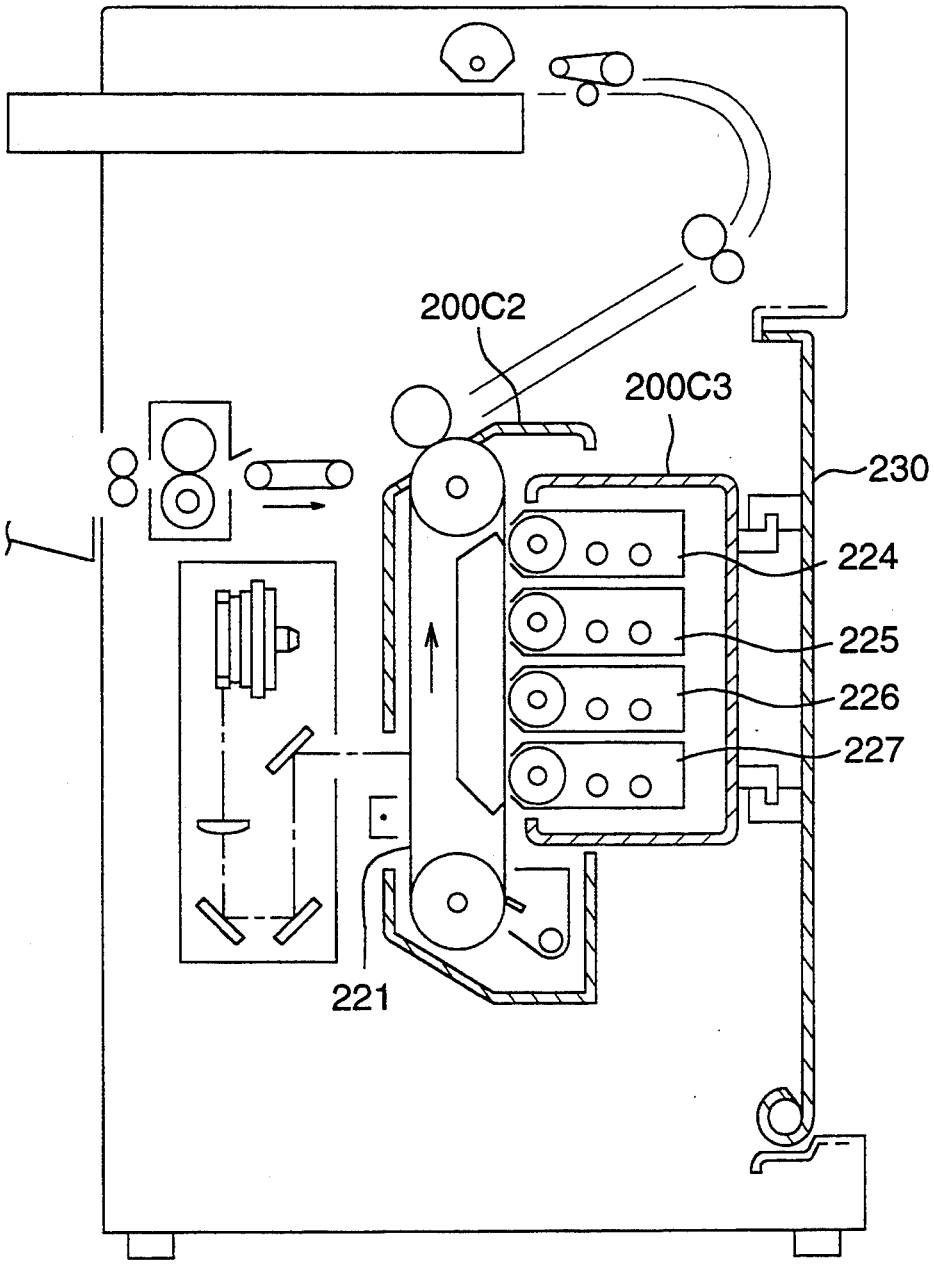
FIG. 16 is a sectional view showing the construction of an image superimposition type color image forming apparatus.
Figure 17:
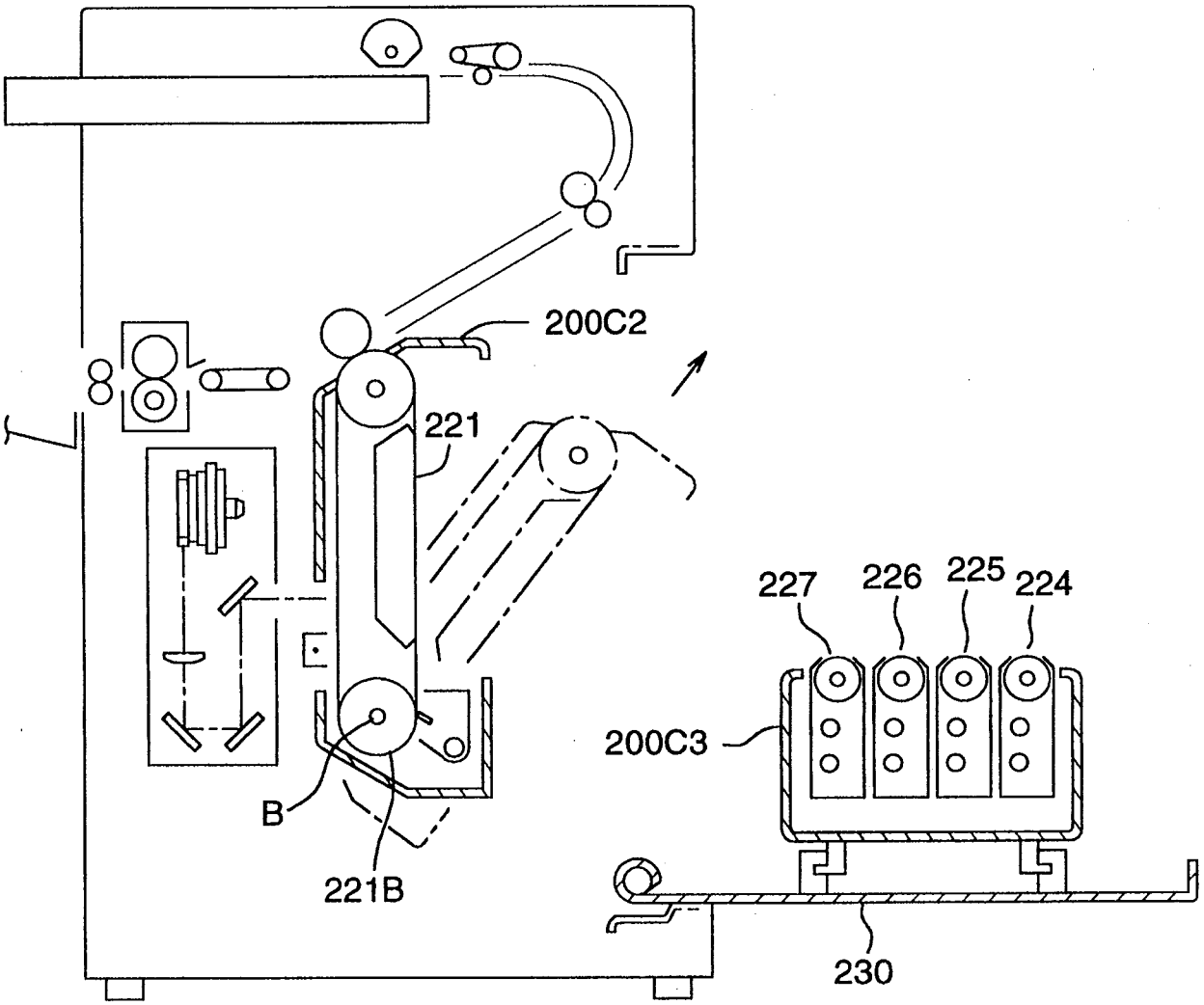
FIG. 17 is a sectional view showing the construction of the above apparatus in the case where the development cartridge is rotated.

FIGS. 16 and 17 show an image superimposition type color image forming apparatus in which the photoreceptor belt 221 is used. Also, in this case, the developing units 224, 225, 226, 227 are integrally assembled to the development cartridge 200C3. The development cartridge 200C3 is detachably provided on the side cover 230 which can be opened and closed.

When the side cover 230 of the color image forming apparatus is opened, the developing units are individually replaced, or the entire development cartridge is replaced. When necessary, the process cartridge 200C2 accommodating the photoreceptor belt 221 can be also replaced.

As illustrated by a one-dotted chain line in FIG. 17, the process cartridge 200C2 is rotated clockwise around the shaft B of the lower rotational roller 221B of the photoreceptor belt 221 so that the process cartridge 200C2 is inclined a little. Under the above condition, the process cartridge 200C2 is pulled out in the arrowed direction. In this way, the process cartridge 200C2 can be taken out from the color image forming apparatus.

Either of the means shown in FIGS. 10 and 11(*a*)–11(*b*) is used for supplying toner according to whether each developing unit is integrated with or separated from the toner hopper.

Only the toner accommodating containers, that is, the toner hoppers connected with each developing unit may be supported by the side cover 230. When the side cover 230 is opened in the above construction, the toner hoppers, developing units and photoreceptor can be replaced.

Figure 18:
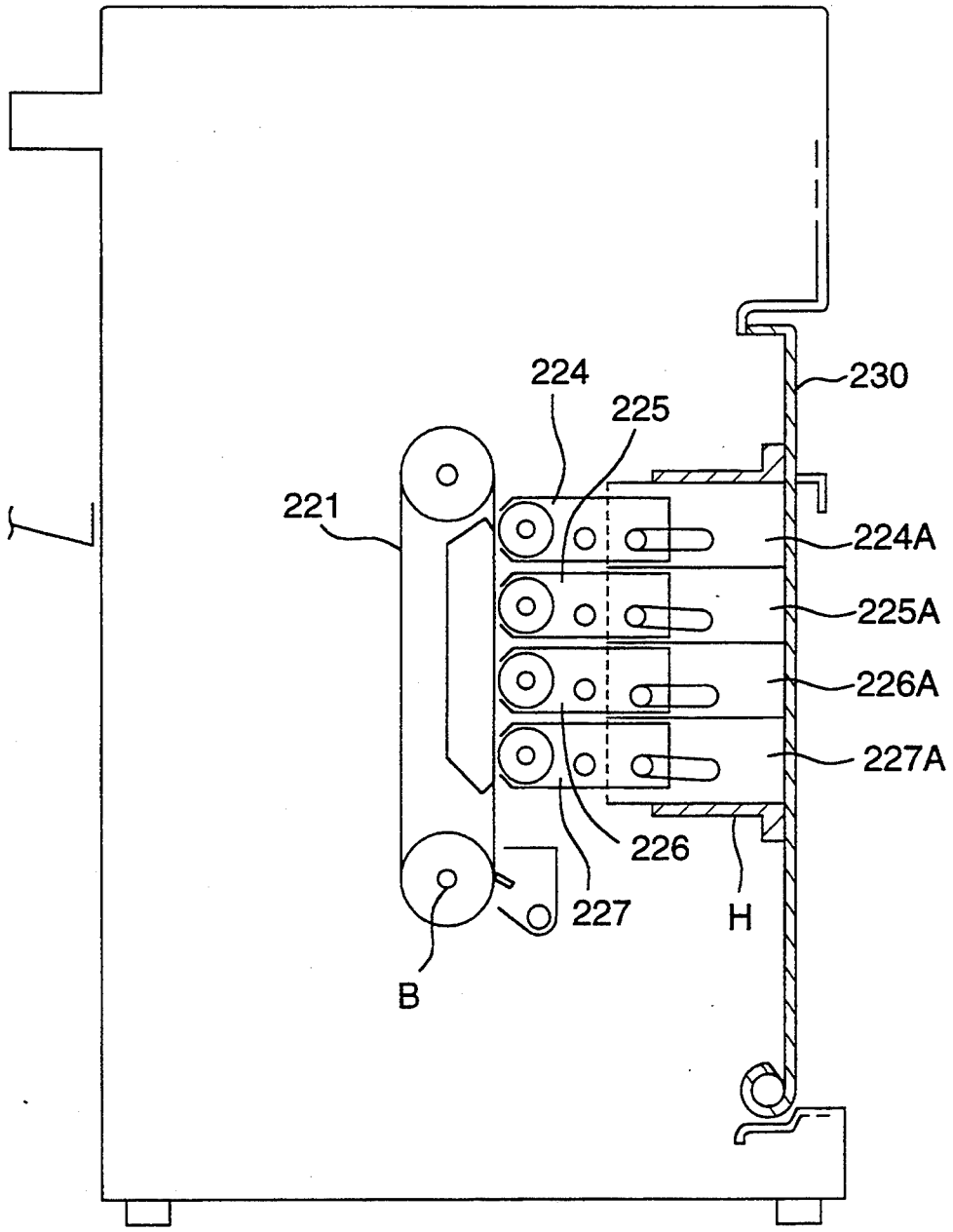
FIG. 18 is a sectional view showing the construction of an image superimposition type color image forming apparatus.
Figure 19:
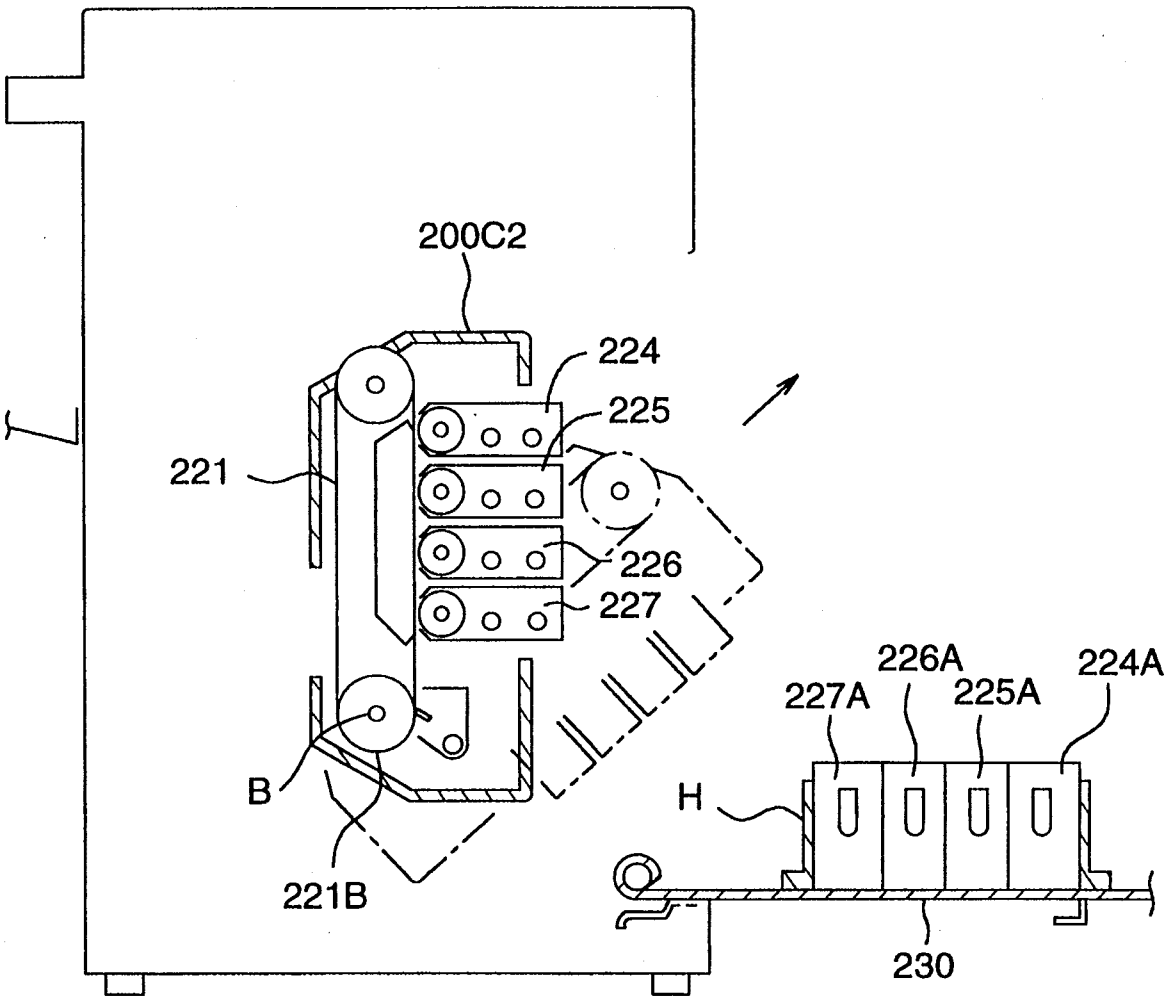
FIG. 19 is a sectional view showing the construction of the above apparatus in the case where the toner recovery container is rotated.

FIGS. 18 and 19 show an example in which the photoreceptor belt 221 is used. The toner hoppers 224A, 225A, 226A, 227A are respectively connected with the developing units 224, 225, 226, 227. In this case, the respective toner hoppers 224A, 225A, 226A, 227A are detachably supported by the holder H provided on the inner surface of the side cover 230.

When the side cover 230 closes the apparatus as illustrated in FIG. 18, each toner hopper is automatically connected with each corresponding developing unit so that toner can be supplied. When the side cover 230 is opened as illustrated in FIG. 19, the toner hopper is automatically disconnected from the developing unit, and moved by a distance longer than that of the developing unit.

Therefore, each toner hopper, developing unit and photoreceptor belt 221 can be individually replaced. In the case where each developing unit and the photoreceptor belt 221 are accommodated in the process cartridge 200C2, in the same manner as that of the previous example, when the process cartridge 200C2 is slightly inclined clockwise as illustrated in FIG. 19, the developing units and the photoreceptor belt 221 can be integrally replaced.

According to the present invention, it is possible to take out a plurality of developing units from the apparatus without the leakage of accommodated toner. As a result, the inside of the apparatus can be maintained clean at all times, and further jam clearance and maintenance such as supplying toner can be easily carried out. The present invention can provide the aforementioned color image forming apparatus suitable for practical use.

What is claimed is:

1. A color image forming apparatus, comprising:

a housing; and a cartridge which is attachable to and detachable from the housing in a horizontal direction, the cartridge including:

a photoreceptor on which a latent image is formed;

a cleaning device disposed at one side of the photoreceptor so as to clean the photoreceptor; and a plurality of developing devices disposed at another side of the photoreceptor positioned to be opposite to the cleaning device;

each developing device having a developing portion facing toward the photoreceptor, a toner-receiving portion positioned to be opposite to the developing portion, a top portion, and a bottom portion, the plurality of developing devices being vertically stacked in a stack so that the bottom portion of one of the developing devices is mounted on the top portion of another one of the developing devices and the developing portion of each developing device is located at a same side of the stack facing toward the photoreceptor; and each developing device having an opening therein to receive toner at the toner-receiving portion thereof and a cover for opening and closing the opening so that when the cartridge is detached from the housing in the horizontal direction and the cartridge is rotated to a laid down position thereof, whereby in the rotated laid down position of the cartridge the photoreceptor is positioned on the cleaning device and further the plurality of developing devices are positioned on the photoreceptor so that the toner-receiving portions of the plurality of developing devices are all positioned vertically relative to the horizontal direction, and the toner-receiving portions of the plurality of developing devices are positioned in a top portion of the rotated cartridge and toner can be supplied into the plurality of developing devices through the openings in the top portions of the developing devices of the rotated cartridge.

2. The apparatus of claim 1, wherein the cleaning device removes residual toner on the photoreceptor, and wherein the cleaning device includes a waste toner box that is adapted to be one of attached to and detached from the cartridge.

3. The apparatus of claim 2, wherein, when the cartridge is detached from the housing, the waste toner box is detachable from the cartridge, provided that the cartridge is not in the rotated position thereof.

4. The apparatus of claim 2, wherein, when the cartridge is detached from the housing and is rotated to the rotated position, the cleaning device is detachable together with the waste toner box from the cartridge in the horizontal direction.

5. The apparatus of claim 1, wherein the photoreceptor is a belt type photoreceptor having a vertical imaging surface.

6. A color image forming apparatus, comprising:

a housing; and a cartridge which is attachable to and detachable from the housing, the cartridge including:

a photoreceptor on which a latent image is formed; and a plurality of developing devices, each developing device having a developing portion facing toward the photoreceptor, a toner-receiving portion positioned to be opposite to the developing portion, a top portion, and a bottom portion, the plurality of developing devices being vertically stacked in a stack so that the bottom portion of one of the developing devices is mounted on the top portion of another one of the developing devices and the developing portion of each developing device is located at a same side of the stack facing toward the photoreceptor; and each developing device having an opening therein to receive toner at the toner-receiving portion thereof and a cover for opening and closing the opening, and each developing device being movable in a horizontal direction independently of a movement of another developing device so that the opening of each developing device is accessible from an outside of the housing by a developing device being moved by a predetermined distance without detaching the cartridge.

7. A color image forming apparatus, comprising:

a housing; and a cartridge which is attachable to and detachable from the housing, the cartridge including:

a photoreceptor on which a latent image is formed; and a plurality of developing devices, each developing device having a developing portion facing toward the photoreceptor, a toner-receiving portion positioned to be opposite to the developing portion, a top portion, and a bottom portion, the plurality of developing devices being vertically stacked in a stack so that the bottom portion of one of the developing devices is mounted on the top portion of another one of the developing devices and the developing portion of each developing device is located at a same side of the stack facing toward the photoreceptor; and each developing device having an opening therein to receive toner at the toner-receiving portion thereof and a cover for opening and closing the opening, the developing devices in the stack being arranged in a form of stairs so that the opening of a first developing device positioned below another developing device in the stack is exposed without a need to move the first developing device.

8. A color image forming apparatus, comprising:

a housing; and a cartridge which is attachable to and detachable from the housing in a horizontal direction, the cartridge including:

a belt type photoreceptor having a slanted imaging surface on which a latent image is formed; and a plurality of developing devices, each developing device having a developing portion facing toward the photoreceptor, a toner-receiving portion positioned to be opposite to the developing portion, a top portion, and a bottom portion, the plurality of developing devices being vertically stacked in a stack so that the bottom portion of one of the developing devices is mounted on the top portion of another one of the developing devices and the developing portion of each developing device is located at a same side of the stack facing toward the belt type photoreceptor;

each developing device having an opening therein to receive toner at the toner-receiving portion thereof and a cover for opening and closing the opening, wherein the plurality of developing devices in the stack are arranged in a form of stairs in relation to the slanted imaging surface so that the opening of a first developing device positioned below another developing device in the stack is exposed provided that a developing device positioned higher in the stack is not moved.

9. A color image forming apparatus, comprising:

a housing; and a cartridge having a rotation axis on which the cartridge is rotated between a first position where the cartridge is attached to the housing and a second position where the cartridge is detached from the cartridge, the cartridge including:

a photoreceptor on which a latent image is formed, the photoreceptor having a rotation axis parallel to the rotation axis of the cartridge; and a plurality of developing devices, each developing device having a developing portion facing toward the photoreceptor, a toner-storing portion positioned to be opposite to the developing portion, a top portion, and a bottom portion, the plurality of developing devices being vertically stacked in a stack on one side of the photoreceptor at the first position of the cartridge so that the bottom portion of one of the developing devices is mounted on the top portion of another one of the developing devices and the developing portion of each developing device is located at a same side of the stack facing toward the photoreceptor; wherein when the cartridge is rotated to the second position thereof, the photoreceptor is positioned in a plane that is above the plurality of developing devices.

10. The apparatus of claim 9, wherein the cartridge further includes a toner supply hopper and wherein the toner supply hopper is replaceable with a spare toner supply hopper at the second position of the cartridge.

11. The apparatus of claim 9, wherein the housing includes a toner supply hopper, and wherein a respective one of the developing devices is engaged with the toner supply hopper when the cartridge is in the first position thereof, and is disengaged from the toner supply hopper when the cartridge is in the second position thereof.

* * * * *